US005477920A

United States Patent [19]

Simmons

[11] Patent Number: 5,477,920

[45] Date of Patent: Dec. 26, 1995

[54] MEMBRANE LINER FOR CASING HEAD OF OIL WELLS AND THE LIKE AND METHOD OF USE THEREFORE

[76] Inventor: Wayne Simmons, 6300 Petersburg, Kodiak, Ak. 99507

[21] Appl. No.: 410,763

[22] Filed: Mar. 27, 1995

[51] Int. Cl.[6] ..... E21B 33/00

[52] U.S. Cl. ..... 166/81.1

[58] Field of Search ..... 166/81–84, 93, 166/97; 405/52

[56] References Cited

U.S. PATENT DOCUMENTS

| | | | |
|---|---|---|---|
| 3,322,198 | 5/1967 | McHenry | 166/81 |
| 5,394,939 | 3/1995 | Walker | 166/81 |

*Primary Examiner*—Michael Powell Buiz
*Attorney, Agent, or Firm*—Michael J. Tavella

[57] ABSTRACT

A removable drip pan for well heads and the like is disclosed. The drip pan is a membrane mat that is split to fit around the well head equipment. The split is sealed with a strip of VELCRO or similar hook and loop type fastener. The seam seal forms a small berm along a radial line from the center to the outer edge. A small berm is also formed around the circumference of the mat to hold any spilled fluids. Finally, an adjustable large diameter collar is attached to the mat. This collar fits around the equipment and can be pulled snugly around the equipment to form a tight seal by using a split strap adjuster. The device is used by fitting the mat around the well head to be worked, closing the seam seal and cinching the collar into position. The collar is designed to be raised or lowered to match the characteristics of a particular well head and to permit work to be performed on the entire well head assembly by setting the collar height as an appropriate working height. A spill skirt is used to cover the top of the collar and to protect the straps from contamination.

16 Claims, 8 Drawing Sheets

MEMBRANE LINER FOR CASING HEAD OF OIL WELLS AND THE LIKE AND METHOD OF USE THEREFORE

BACKGROUND OF THE INVENTION

Completed oil wells have piping and a valve assembly installed on the top of the well casing. This valve assembly is often called an oil well head (or tree) in oil field jargon. The configuration of this well head can vary from well to well. These well heads are often protected by well houses. A typical well house is a small building, approximately 20 feet square. The well house provides a sheltered environment for the well head and permits work crews to maintain the well heads in relative comfort. Installed within the floor, and surrounding the well head, is a cellar. The cellar is used during the drilling phase of the well development. This cellar typically has a metal grate installed over it to provide a level work surface. With today's environmental regulations, oil, hydraulic fluid, drilling mud and other contaminants are no longer permitted to be spilled into the cellar. This means that whenever a well head needs service, care must be taken to catch and collect any spilled contaminants that may escape from the piping.

A few devices have been developed to collect spilled products from well casings. One example, U.S. Pat. No. 4,673,034 to Hansen, discloses a flexible pad that is designed to funnel liquids away from the casing of water wells. This device is used to stop runoff that percolates down around a casing, which may contaminate the well water. The device has a ring that is fastened to the casing using a hose clamp. The ring is attached to a circular skirt that is sloped down and away from the well casing. This design, therefore, is designed to move liquid away from the casing. It also has no provision to catch or contain the runoff.

Two patents that are useful in collecting oil or other liquids are found in U.S. Pat. Nos. 5,098,220 to Norman and 5,101,868 to Balch. The Norman Patent is designed to cover and protect a shallow pit by placing an impermeable membrane into the bottom of the pit. It is a large sheet of material with a circular hole in the center. The sheet is split to the center to permit it to be spread it around a well casing and then close it to secure it for use. A special collar is provided to provide a leak-proof seam around the casing. The unit is sealed in place by a second sheet that is one-half the size of the lower sheet. This sheet has no seams and is designed to be glued over the seam of the lower sheet. In this way, a permanent liner for the pit is created. Although this device is adequate for a permanent pit liner, it is not designed for temporary use. The top sheet is glued to the lower sheet to ensure a good seal. Once glued in place, the mat cannot be removed unless it is cut.

The Balch patent teaches a design for catching spills involving fill pipes. Here, the device is a funnel-shaped basket that is fastened to a pipe with liquid-tight fasteners. The basket catches any spilled liquid from the pipe. Although this device works well on narrow diameter pipes, it does not appear readily convertible for use over a typical well head, which has large valves and other appurtenances and is not uniform in shape. Also, the technique of using elastic bands to form a liquid tight seal, as taught by Balch, is impractical where the shapes of the objects to be sealed are nonuniform.

SUMMARY OF THE INVENTION

The present invention overcomes these difficulties. It is a membrane mat that is split to fit around the well head equipment. The split is sealed with a strip of VELCRO or a similar hook and loop type fastener. The seam seal also has a block of foam, or similar material, attached to one side of the seal that forms a small berm along a radial line from the center to the outer edge. A small berm is also formed around the circumference of the mat to hold any spilled fluids. Finally, an adjustable large diameter collar is attached to the mat. This collar fits around the equipment and can be pulled snugly around the equipment to form a tight seal by using a split strap and two buckles.

The device is used by fitting the mat around the well head to be worked, closing the seam seal, and setting and locking the collar in place, The collar is designed to be raised or lowered to match the characteristics of a particular well head and to permit work to be performed on the entire well head assembly by setting the collar height at an appropriate working height. Finally, a skirt can be attached over the collar to prevent any spills from leaking under the collar and to protect the straps and buckles from fluids and dirt.

It is an object of this invention to develop a portable drip pan for well head sites that can be set up and removed quickly and efficiently.

It is another object of this invention to develop a portable drip pan for well head sites that has an adjustable collar to seal the drip pan around the well head.

It is yet another object of this invention to develop a portable drip pan for well head sites that has an adjustable collar to seal the drip pan around the well head wherein the collar can be adjusted quickly and easily to fit around objects having a variety of shapes and sizes.

It is a further object of this invention to provide a drip skier to fit over the collar to direct any spilled liquids to flow into the drip pan so as to prevent leaks around the collar and to protect the adjustment mechanism on the collar.

DETAILED DESCRIPTION OF THE INVENTION

Figure 1:
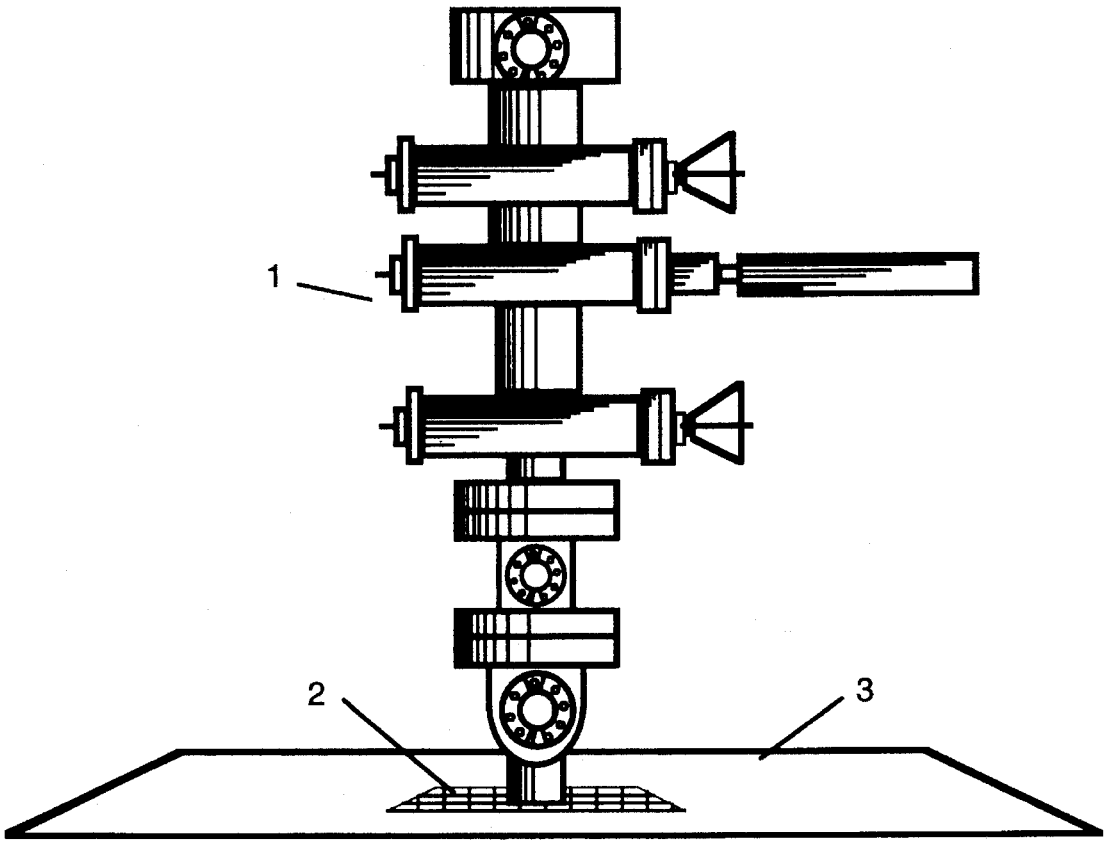
Figure 1 Prior Art
FIG. 1 is a front view of a typical well head pipe string as prior art.

FIG. 1 is a side view of a typical well head 1. It has a floor grate 2, that is installed above a cellar (not shown). In cold climates, the well head typically sits in a building (not shown) that has a floor 3. The well head has a number of pipes and valves that need maintenance from time to time. Past practice has been to work on the well head without protection. Any spilled liquids or fluids fell on the floor 3 or fell into the cellar. Today, such practices are prohibited. Great care is taken to ensure that spilled fluids are captured and collected for proper disposal. Current practice calls for allowing no fluids to be dumped into the cellar or surrounding area.

Figure 2:
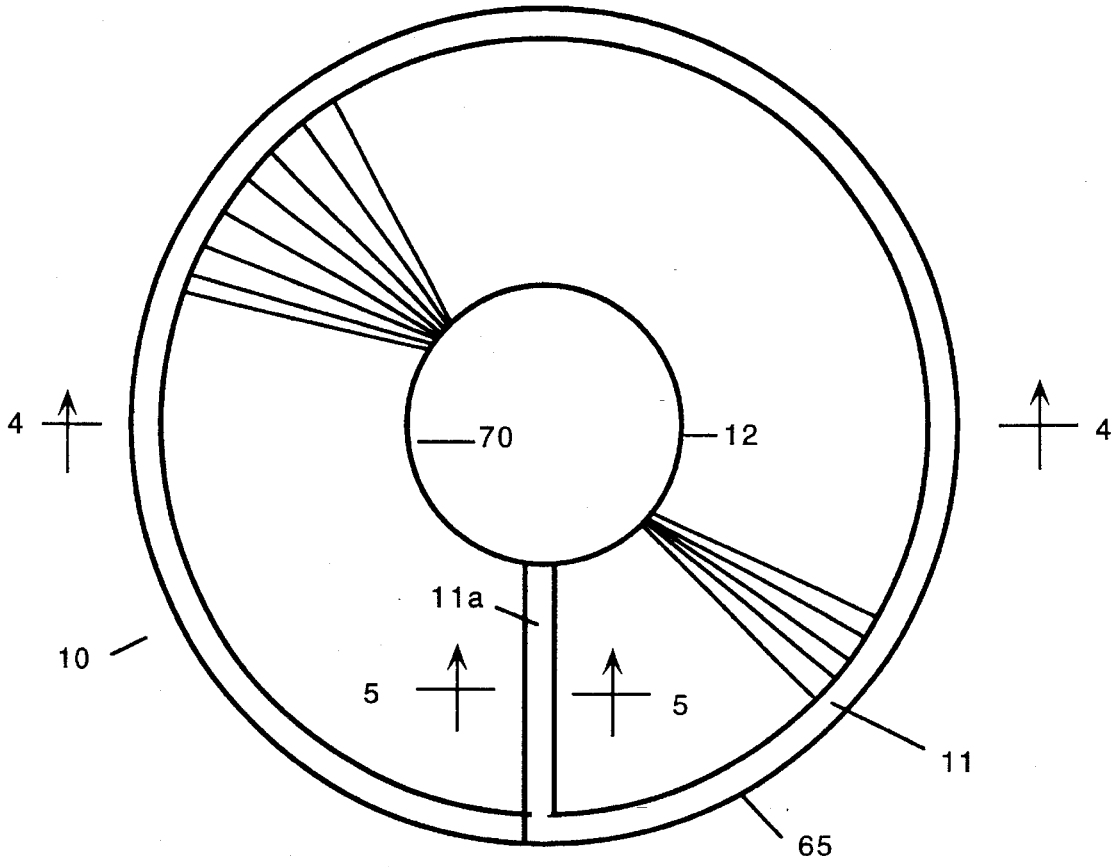
FIG. 2 is a top view of the invention.
Figure 3:
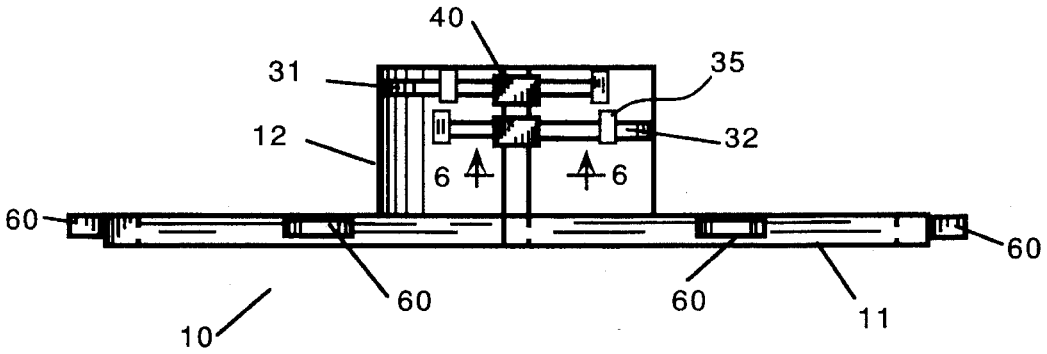
FIG. 3 is a front view of the invention.
Figure 4:
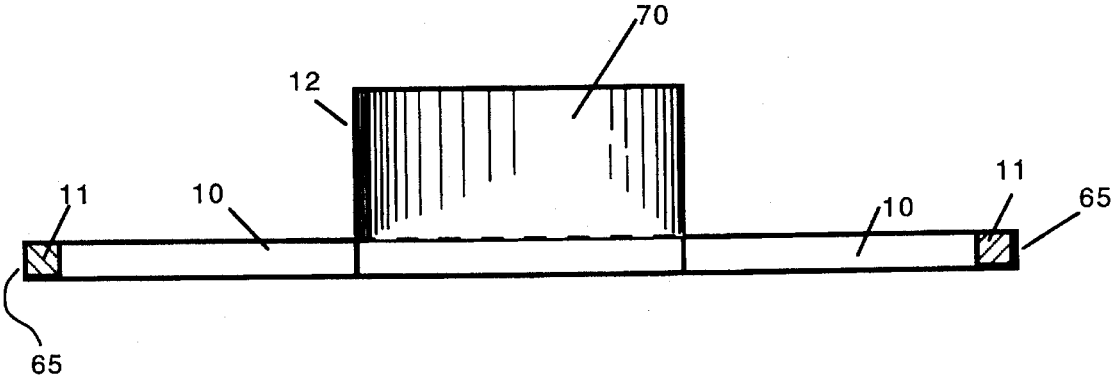
FIG. 4 is a cross-sectional view of the invention taken along the lines 4—4.
Figure 15:
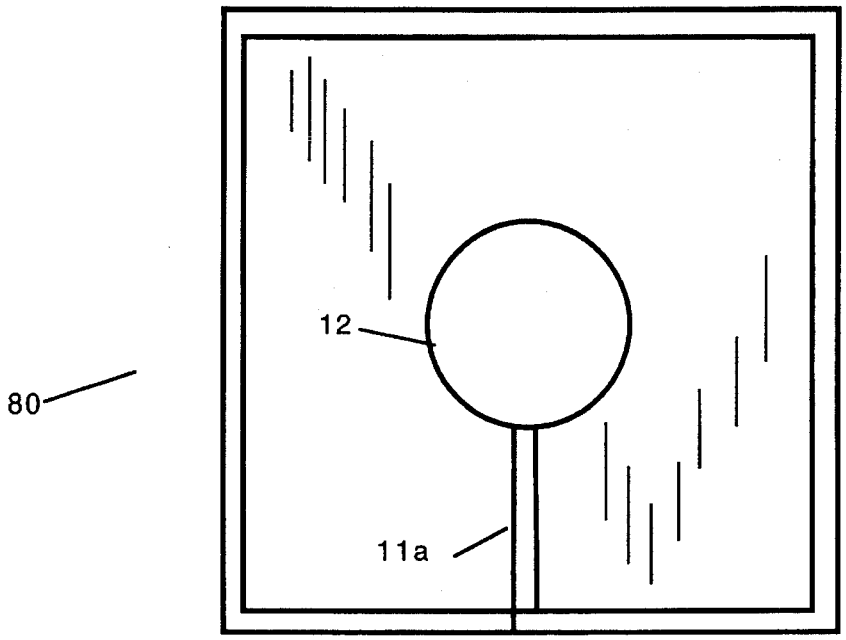
FIG. 15 is a top view of the pad shaped as a square.
Figure 16:
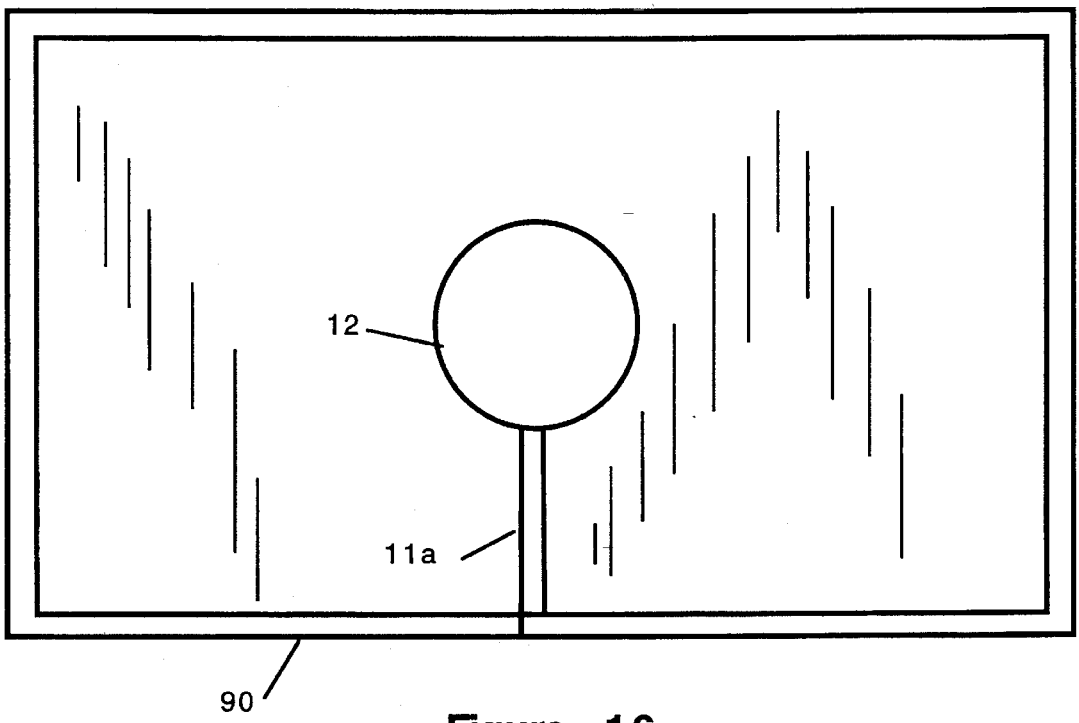
FIG. 16 is a top view of the pad shaped as a rectangle.

Referring now to FIGS. 2, 3 and 4, the present invention is designed to prevent fluids from entering the cellar during well head 1 maintenance. The invention is a circular pad 10 that forms a drip pan. The lower portion of the circular pad 10 is designed to fit over the floor grate 2. In the preferred embodiment, the pad is generally flat. In the preferred embodiment, the pad is approximately ten feet in diameter. Of course, the pad can be a square 80 (see FIG. 15) or rectangular 90 (see FIG. 16) or any other shape. The circular pad is preferred. A berm 11 is formed around the circumference, or outer perimeter 65, of the pad 10 to contain spilled fluids within the pad. The berm 11 is a foam pad. In the preferred embodiment, the berm 11 is four inches square. The foam pad that makes up the outer berm 11 is sewn into the material that makes up the circular pad 10. See FIG. 4. The covering material is folded over the foam and stitched to seal the foam in place. See also FIG. 5.

The circular pad 10 has an integral collar 12 that is placed around the well head 1 to provide a tight seal. The collar 12 is attached to a circular opening cut into the center of the circular pad 10. This circular opening forms an inner perimeter 70, to which the collar 12 is attached. See FIG. 4.

Figure 5:
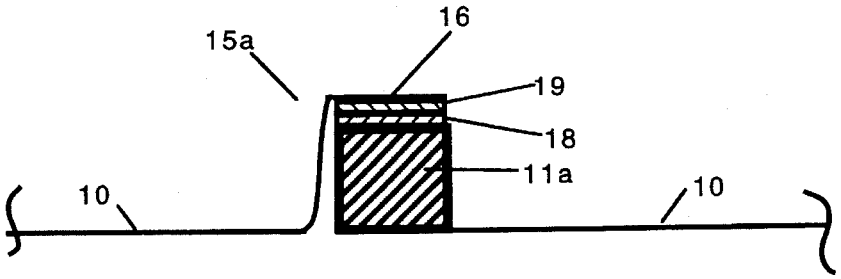
FIG. 5 is a detail section view of the floor seam taken along the lines 5—5.
Figure 6:
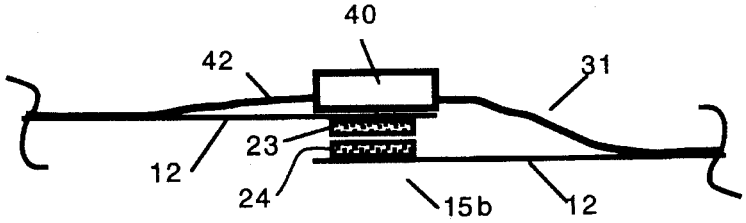
FIG. 6 is a detail section view of the collar seam taken along the lines 6—6.

A seam 15 is provided to allow the invention to be placed around a well head 1. Once the circular pad 10 is in place, the seam 15 is sealed. FIGS. 5 and 6 show details of the seal.

FIG. 5 shows the seam **15*a* in the circular pad 10 itself. Note that an additional berm 11*a* runs from the perimeter of the pad 10 to the collar 12. A cover flap 16 runs the entire length of the berm 11*a*. The cover flap 16 provides a seal for the circular pad 10. in the seam between the outer berm 11. The cover flap 16 fits over the berm 11*a* as shown in FIG. 5**.

To seal the cover flap 16, a strip of VELCRO, a hook and loop fastening system, 18 runs the length of the berm **11*a*. A corresponding strip of VELCRO 19 is installed on the cover flap 16 that rests on the top of the berm 11*a*. Thus, if the hook portion of the VELCRO 18 is attached to the berm 11*a*, then the loop portion of the VELCRO 19 is attached to the cover flap 16. See FIG. 5**.

The collar seam **15*b* runs from the circular pad 10 to the top of the collar 12. Seam 15*b* is formed from two corresponding strips of VELCRO 23 and 24 as shown in FIG. 6. The strips 23 and 24 are overlapped and sealed by pressing the strips together. Similarly, if other fasteners are used, the seam 15*b*** is sealed by using the appropriate methods.

In the preferred embodiment, VELCRO is the preferred sealing means. However, any other similar fastener can be substituted.

Figure 10:
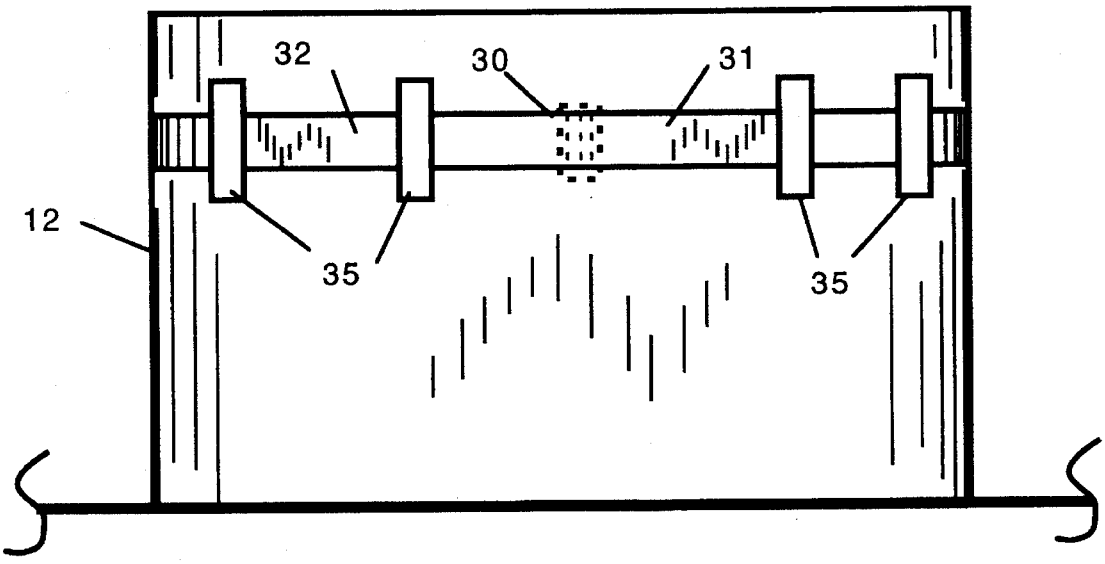
FIG. 10 is a rear detail view of the strap-buckle cinching system.

Referring now to FIGS. 2, 7, 8, and 9, the system of sealing the device around a well head 1 is shown. Although the seam **15*b* is closed and sealed, the collar 12 is designed to be oversized so that it can fit around the different sized components found on the well head 1. To close the collar 12 and form a tight seal around the well head 1, a system of straps is used. This system uses a split strap 30. The split strap 30 is formed of one length of strapping material. This strap is sewn into the collar 12 fabric or is otherwise attached to the collar 12 at the center of the back of the collar 12 as shown in FIG. 10. By securing the strap 30 as shown, two independent straps 31 and 32 are formed. Two buckles 40 and 41 are provided to secure the straps 31 and 32. The buckles each have a securing strap 42 and 43 as shown. These securing straps are sewn onto the collar 12 as shown. The straps 31 and 32 are then passed through the buckles 40 and 41 as shown. Use of the split strap 30 and two buckles 40 and 41 permit each side of the collar 12 to be cinched up separately, ensuring a tight seal over odd shaped components. To help maintain the position of the straps 31 and 32, a number of loops 35 are provided in the preferred embodiment. The loops 35 are placed around the collar 12** at spaced intervals.

In the preferred embodiment, the device is made of an 18 ounce medium duty vinyl coated polyester fabric. This fabric is designed to have a high tensile strength, high abrasion resistance, high puncture resistance, high cold temperature resistance, high flex resistance and must be heat sealable. An example of such a material is sold under the trademark "TUFF TARP" made by Cooley, Inc. Its product "TXN-18" has the following characteristics:

| | |
|---|---|
| Tensile grab: | 450 × 400 lbs. |
| Tear, tongue: | 80 × 100 lbs. |
| Adhesion of coating: | 25 lbs/2 in. |
| Abrasion, Taber H-18-1000 gram: | 250 cycles |
| Hydrostatic: | 600 lbs per sq. in. |
| Low temperature: | −65° F. |
| High temperature: | |
| Intermittent | 200° F. |
| Continuous | 180° F. |

Any material having similar characteristics may be substituted.

Referring now to FIG. 3, a series of handles 60 are provided to assist in moving the pad into position around a well head 1 or to pack the pad for storage.

Figure 7:
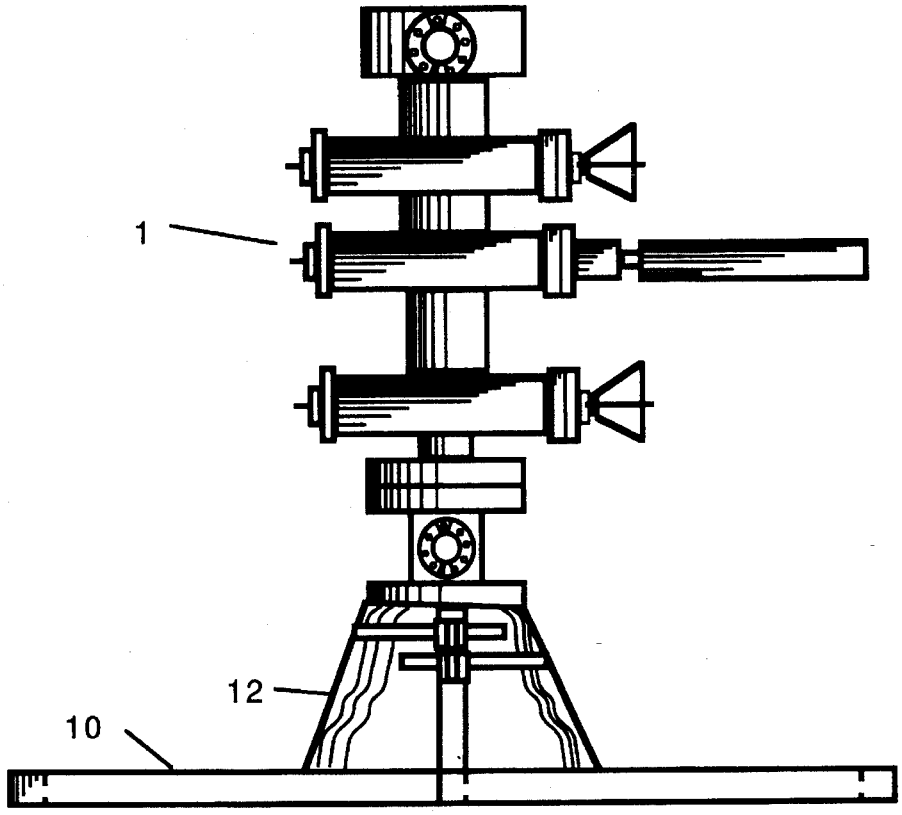
FIG. 7 is a detail front view of the invention as installed on a typical well head at one level shown without the skirt.
Figure 8:
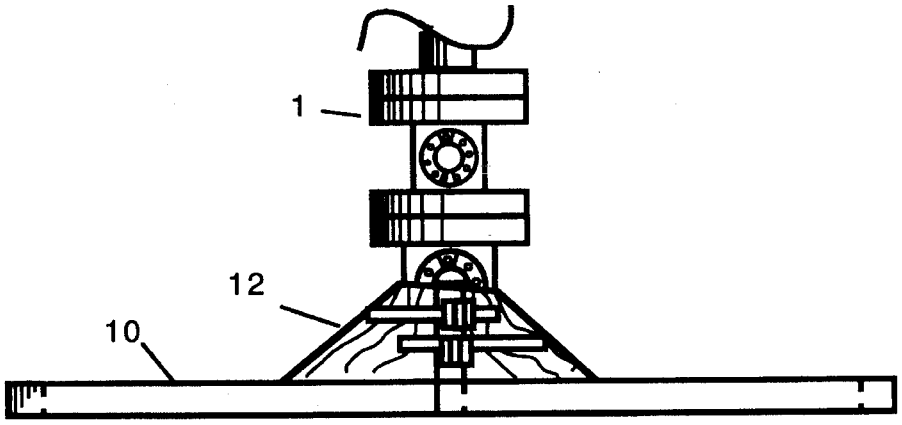
FIG. 8 is a detail front view of the invention as installed on a typical well head at a second level shown without the skirt.
Figure 9:
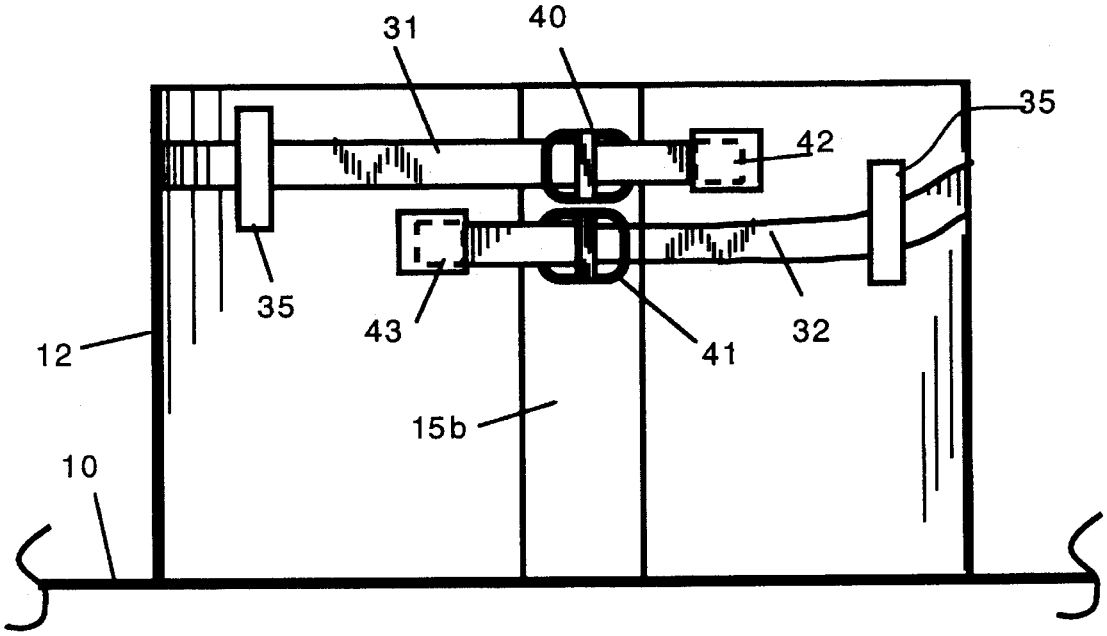
FIG. 9 is a front detail view of the strap-buckle cinching system.

In use, the device is installed around the well head 1 as shown in FIGS. 7 and 8. The collar 12 is placed around the well head 1 at the appropriate level for service. The seam **15*b* is then closed an sealed. Once sealed, the straps 31 and 32 are used to cinch the collar 12 tightly around the well head 1. The straps 31 and 32 provide a versatile method of ensuring a good seal. As the straps 31 and 32 are secured and tightened, the collar 12 pleats, rather than bunches up around the well head 1. This pleating action helps to ensure a tight seal because the pleats give a smooth closure of the collar 12** as the device is tightened. Any type of connector may be used as long as the connectors allow smooth tightening of the straps and then hold the straps in a secure, tightened position until released, i.e., the connectors will not slip under pressure.

Figure 11:
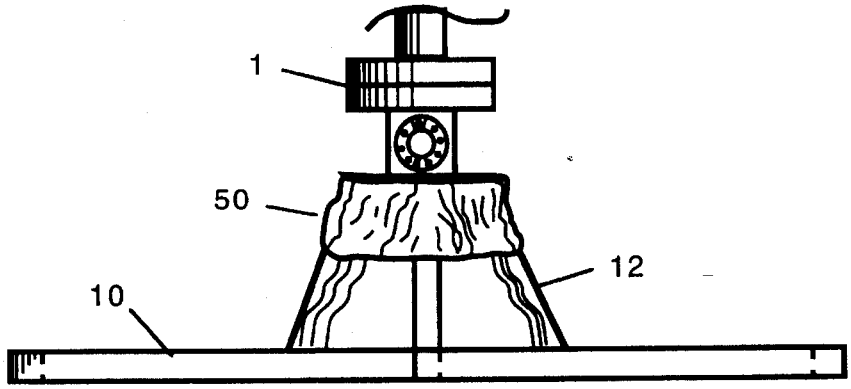
FIG. 11 is a detail front view of the invention as installed on a typical well head at one level shown with the skirt.
Figure 12:
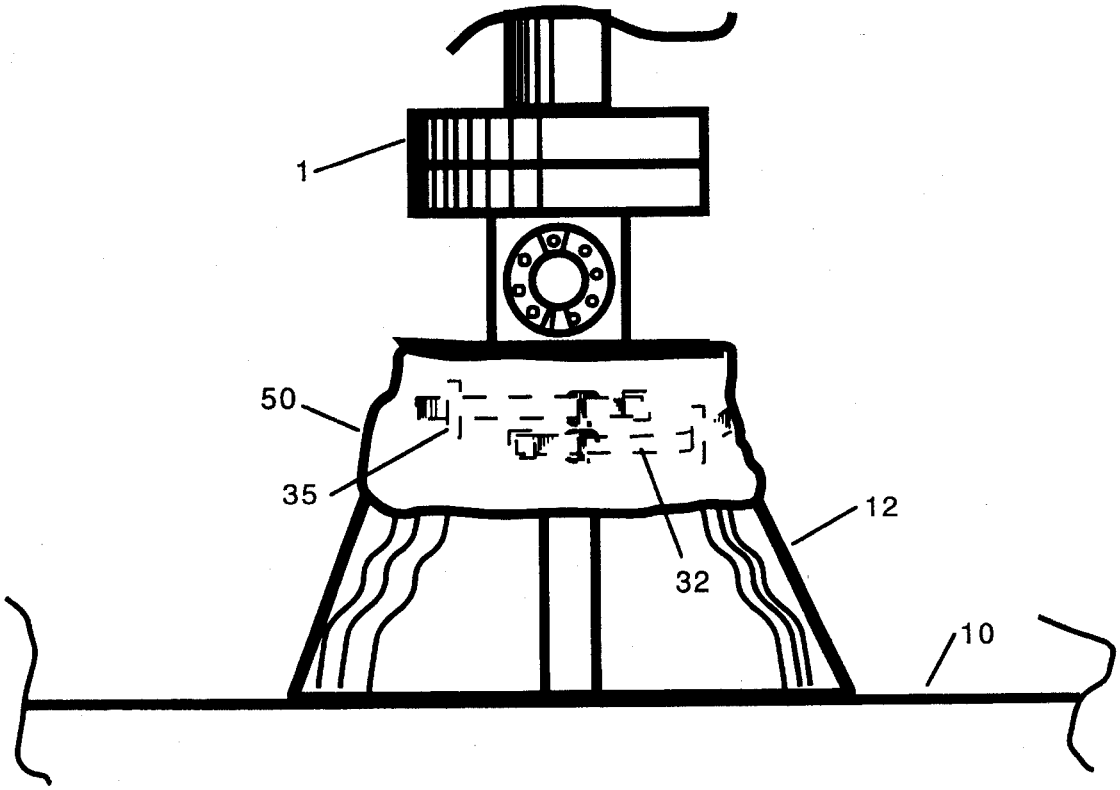
FIG. 12 is an enlarged detail front view of the invention as installed on a typical well head shown with the skirt.
Figure 13:
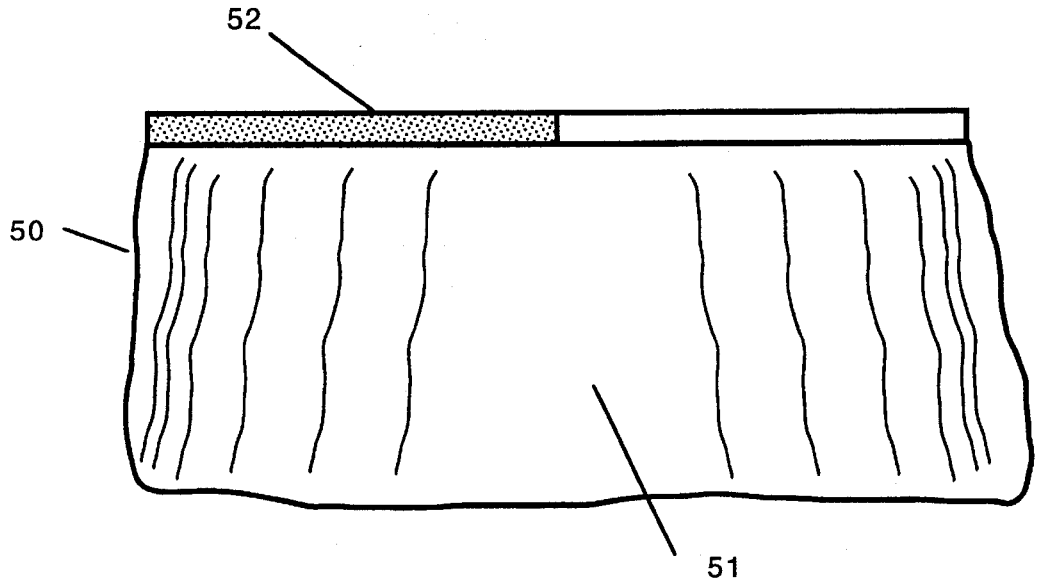
FIG. 13 is a detail view of the front of the skirt.
Figure 14:
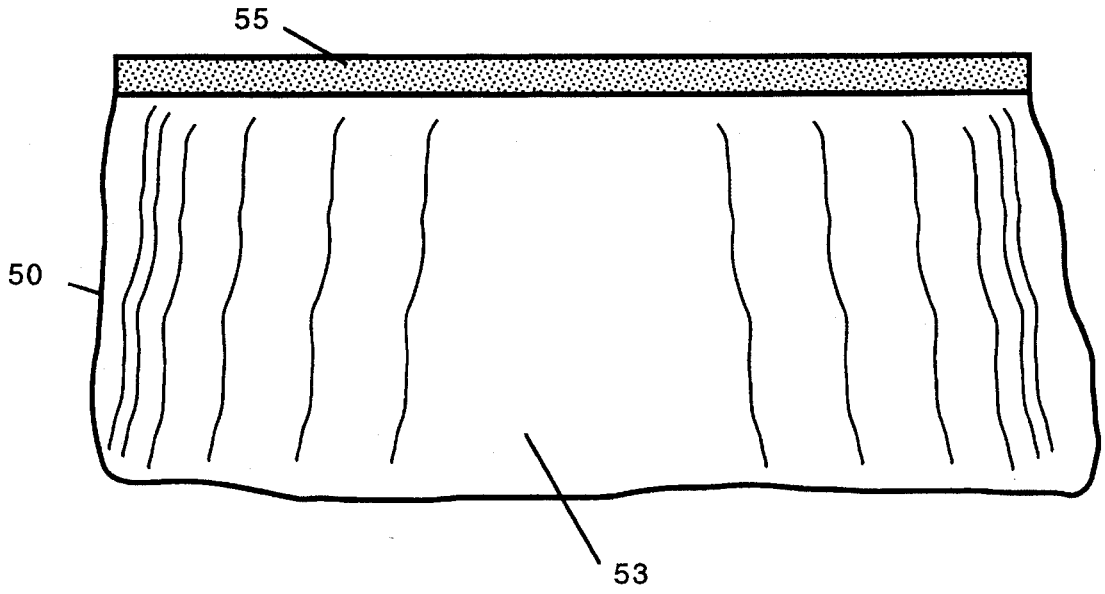
FIG. 14 is a detail view of the back of the skirt.

Although the cinched straps provide a good seal, the pleats cannot completely seal the well head 1 because of odd shaped components. Even if the collar 12 were installed on a smooth pipe, the pleats have small openings that might allow fluids to leak through. To prevent leakage, a spill skirt 50 is installed around the well head 1 above the collar 12. FIGS. 13 and 14 show the skirt 50. FIG. 13 shows the back or inside 51 of the skirt 50. The inside 51 of the skirt 50 has a strip of VELCRO 52 or similar hook and loop type fastener attached to one half of the top of the skirt 50, as shown. FIG. 14 shows the front or outside 53 of the skirt 50. The outside 53 of the skirt 50 has a strip of VELCRO 55 or similar hook and loop type fastener attached completely across the top of the skirt 50 as shown. In this way, the outside 53 of the skirt 50 is placed against the well head. The skirt 50 is then positioned around the well head until it overlaps the beginning point. The VELCRO on the inside of the skirt 52 is then pressed against the Velcro on the outside of the skirt 53, sealing the skirt 50 around the well head. The placement of the VELCRO strips, as discussed above, permits the inside piece to overlap at any point on the outside surface of the skirt 53, thereby making the skirt 50 adjustable to any diameter pipe. The skirt 50 is designed to hang down over the strap 30 and buckles 40 and 41 as shown in FIGS. 11 and 12. The skirt 50 not only ensures that leaks or drips are passed down into the pad, it also acts to keep the straps and buckles free and clean of fluids, drilling mud, grease, and other contaminants, thereby ensuring smooth operation and a long life for the straps.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A drip pan for an oil well head comprising:

a) a pad having an outer perimeter and a center, the center being open thereby forming an inner perimeter;

b) means for forming a berm along said outer perimeter of said pad;

c) a collar, fixedly attached to said inner perimeter;

d) means for opening said pad and collar such that said pad and collar may be placed around said oil well head;

e) means for sealing said pad and collar; and f) means for cinching said collar about said oil well head to form a tight seal about said oil well head.

2. The drip pan for an oil well head of claim 1 further comprising: a flexible skirt removably placed around said collar to catch spilled liquids and to channel said liquids into the drip pan.

3. The drip pan for an oil well head of claim 1 further comprising: a means for forming a berm along said means for sealing said means for opening said pad.

4. The drip pan for an oil well head of claim 1 wherein said means for cinching said collar about said oil well head to form a tight seal about said oil well head comprises a strap having a center, a first end, and a second end, wherein said strap is fastened to said collar at the center of said strap and wherein said first end attaches to a first means for adjusting said strap and the second end attaches to a second means for adjusting said strap.

5. The drip pan for an oil well head of claim 1 wherein the pad has a circular shape.

6. The drip pan for an oil well head of claim 1 wherein the pad has a square shape.

7. The drip pan for an oil well head of claim 1 wherein the pad has a rectangular shape.

8. The drip pan for an oil well head of claim 4 wherein the first and second means for adjusting said strap comprise a pair of buckles fixedly attached to said collar.

9. A drip pan for an oil well head comprising:

a) a flat pad being formed of an oil resistant material and having an outer perimeter and a center, the center being open thereby forming an inner perimeter, said flat pad also having a split along a radius line from the outer perimeter to the inner perimeter, wherein the split has two sides;

b) a foam rubber berm formed about said outer perimeter and being covered by said oil resistant material;

c) a collar, fixedly attached to said inner perimeter and also being spilt along a latitudinal axis of said collar, said split having two sides;

d) a strip of hook and loop fastener material having a hook portion and a loop portion, being fixedly attached to said flat pad at said split, whereby the hook portion of said strip is attached to one said of the spilt and the loop portion of said strip is attached to the other side of the split, such that when said hook portion and said loop portion are overlapped, said split is sealed;

e) a strip of hook and loop fastener material having a hook portion and a loop portion, being fixedly attached to said collar at said split whereby the hook portion of said strip is attached to one said of the spilt and the loop portion of said strip is attached to the other side of the split, such that when said hook portion and said loop portion are overlapped, said split is sealed;

f) a strap having a center, a first end and a second end, wherein said strap is fastened to said collar at the center of said strap and wherein said first end attaches to a first means for adjusting said strap and the second end attaches to a second means for adjusting said strap, such that when the ends of said strap are engaged and pulled, said strap cinches the collar about said well head; and g) a flexible skirt removably placed around said collar to catch drips and channel said drips onto the flat pad.

10. The drip pan for an oil well head of claim 9 wherein the shape of the flat pad is circular.

11. The drip pan for an oil well head of claim 9 wherein the shape of the flat pad is square.

12. The drip pan for an oil well head of claim 9 wherein the shape of the flat pad is rectangular.

13. The drip pan for an oil well head of claim 9 wherein the first and second means for adjusting said strap comprise a pair of buckles fixedly, and independently, attached to said collar.

14. The drip pan for an oil well head of claim 9 further comprising a berm, fixedly installed along said split in said flat pad.

15. The method of assembling a drip pan around a well head, having a pad having an outer perimeter and a center, the center being open thereby forming an inner perimeter, a means for forming a berm along said outer perimeter of said pad, a collar, fixedly attached to said interior perimeter, a means for opening said pad and collar such that said pad and collar may be placed around said well head, a means for sealing said pad and collar, a means for cinching said collar about said well head to form a tight seal about said well head, and a skirt to cover the collar, comprising the steps of:

a) opening said means for opening said pad and collar in said pad and collar;

b) placing said pad and collar about said well head;

c) aligning and sealing said means for sealing said pad and collar; and d) tightening said means for cinching about said collar to form a tight seal about said well head.

16. The method of assembling a drip pan around the well head of claim 1 further comprising the steps of: placing a skirt over said collar to prevent fluids from contacting said collar and to direct said fluids into said pad.

* * * * *